US007210758B2

(12) United States Patent
Corner et al.

(10) Patent No.: US 7,210,758 B2
(45) Date of Patent: May 1, 2007

(54) MEDIA FEED CALIBRATION

(75) Inventors: David M. Corner, San Diego, CA (US); Peter J. Fellingham, San Diego, CA (US); David A. Neese, Escondido, CA (US)

(73) Assignee: Eastman Kodak Company, Rochester, NY (US)

( * ) Notice: Subject to any disclaimer, the term of this patent is extended or adjusted under 35 U.S.C. 154(b) by 298 days.

(21) Appl. No.: 11/029,086

(22) Filed: Jan. 4, 2005

(65) Prior Publication Data

US 2006/0146085 A1 Jul. 6, 2006

(51) Int. Cl.
*B41J 29/38* (2006.01)

(52) U.S. Cl. ..... 347/16; 347/19; 347/5

(58) Field of Classification Search ..... 347/16, 347/19, 5, 9, 41, 15; 358/1–9
See application file for complete search history.

(56) References Cited

U.S. PATENT DOCUMENTS 6,137,592 A 10/2000 Arquilevich et al. ..... 358/1.8
6,183,055 B1 * 2/2001 Kanematsu et al. ..... 347/9
6,874,864 B1 * 4/2005 Maeda et al. ..... 347/41

* cited by examiner

*Primary Examiner*—Manish S. Shah
*Assistant Examiner*—Lam S. Nguyen

(57) ABSTRACT

A novel method and system for calibration of paper feed in an ink jet printing system is used to remove overfeed bands and underfeed bands from an image. The method begins by feeding print media into the ink jet printing system. A color density test target is formed by simultaneously applying an on/off pattern print mask to print numerous print swaths while incrementing paper feed values. Each paper feed value corresponds respectively to each print swath. The color density test target reveals shifts from light to dark to light in order to identify a maximum optical density region. The paper feed value from the color density test target corresponding to a maximum optical density region on the color density test target is selected and entered into the printing system. The entered value calibrates printing system in order to minimize the presence of overfeed bands and underfeed bands while printing.

15 Claims, 5 Drawing Sheets

| | | | | | | | | | | | |
|---|---|---|---|---|---|---|---|---|---|---|---|
| ON | OFF | ON | OFF | ON | OFF | ON | OFF | ON | OFF | ON | OFF |
| OFF | ON | OFF | ON | OFF | ON | OFF | ON | OFF | ON | OFF | ON |
| ON | OFF | ON | OFF | ON | OFF | ON | OFF | ON | OFF | ON | OFF |
| OFF | ON | OFF | ON | OFF | ON | OFF | ON | OFF | ON | OFF | ON |
| ON | OFF | ON | OFF | ON | OFF | ON | OFF | ON | OFF | ON | OFF |
| OFF | ON | OFF | ON | OFF | ON | OFF | ON | OFF | ON | OFF | ON |
| ON | OFF | ON | OFF | ON | OFF | ON | OFF | ON | OFF | ON | OFF |
| OFF | ON | OFF | ON | OFF | ON | OFF | ON | OFF | ON | OFF | ON |
| ON | OFF | ON | OFF | ON | OFF | ON | OFF | ON | OFF | ON | OFF |
| OFF | ON | OFF | ON | OFF | ON | OFF | ON | OFF | ON | OFF | ON |
| ON | OFF | ON | OFF | ON | OFF | ON | OFF | ON | OFF | ON | OFF |
| OFF | ON | OFF | ON | OFF | ON | OFF | ON | OFF | ON | OFF | ON |
| ON | OFF | ON | OFF | ON | OFF | ON | OFF | ON | OFF | ON | OFF |
| OFF | ON | OFF | ON | OFF | ON | OFF | ON | OFF | ON | OFF | ON |
| ON | OFF | ON | OFF | ON | OFF | ON | OFF | ON | OFF | ON | OFF |
| OFF | ON | OFF | ON | OFF | ON | OFF | ON | OFF | ON | OFF | ON |
| ON | OFF | ON | OFF | ON | OFF | ON | OFF | ON | OFF | ON | OFF |
| OFF | ON | OFF | ON | OFF | ON | OFF | ON | OFF | ON | OFF | ON |
| ON | OFF | ON | OFF | ON | OFF | ON | OFF | ON | OFF | ON | OFF |
| OFF | ON | OFF | ON | OFF | ON | OFF | ON | OFF | ON | OFF | ON |

26

FIGURE 3

MEDIA FEED CALIBRATION

FIELD OF THE INVENTION

The present embodiments relate generally to manners of banding related to media feed.

BACKGROUND OF THE INVENTION

For desktop printers, such as ink jet printers, a media sheet is picked from an input tray and moved along a media path into a print zone where characters, symbols or graphics are printed onto the media sheet. For scanning-type ink jet printers, the media sheet is fed incrementally as a printhead scans across the media sheet. Typically, the media sheet is moved by a linefeed distance between or during printing to a given line.

The media handling system for an ink jet printer includes a set of rollers which move a media sheet along a media path. The rollers are driven by a drive shaft, which is driven by a drive motor. In many instances, an intermediary gearing is used to vary the motion of the rollers. A print controller controls the drive motor.

For printing from a desktop computer, a user typically issues a print command within an application program environment. A file specified by the user then is downloaded to the printer for printing. Typically, a printer driver handles the communication interface between the computer and the printer. For text printing, a conventional print driver issues linefeed commands within a stream of character data so that the character data is printed in a desired visual format, (e.g., with desired margins and desired line spacing). The print controller controls timing for printing characters that achieve the desired format. Such timing is determined by the print driver commands, the data stream and fixed parameters. The fixed parameters are based upon a given physical configuration of a printer. Linefeed distance typically is based upon one or more of these fixed parameters for text, graphic and imaging processing. For example, for text printing the line spacing (e.g., 1, 1.5 or 2) is based upon the fixed linefeed parameter.

The present embodiments are directed to methods for adjusting the linefeed distance.

SUMMARY OF THE INVENTION

A novel method for calibration of paper feed in an ink jet printing system is used to remove overfeed bands and underfeed bands from an image. The method begins by feeding print media into the ink jet printing system. A color density test target is formed by simultaneously applying an on/off pattern print mask to print numerous print swaths while incrementing paper feed values. Each paper feed value corresponds respectively to each print swath. The color density test target reveals shifts from light to dark to light in order to identify a maximum optical density region. The paper feed value from the color density test target corresponding to a maximum optical density region on the color density test target is selected and entered into the printing system. The entered value calibrates printing system in order to minimize the presence of overfeed bands and underfeed bands while printing.

The present embodiments are advantageous over the prior art because the method enables calibration to reduce overfeed and underfeed banding in images from ink jet printing system.

BRIEF DESCRIPTION OF THE DRAWINGS

In the detailed description of the preferred embodiments presented below, reference is made to the accompanying drawings, in which:

FIG. 3 examples an on/off pattern print mask with a checkerboard embodiment.

Figure 1:
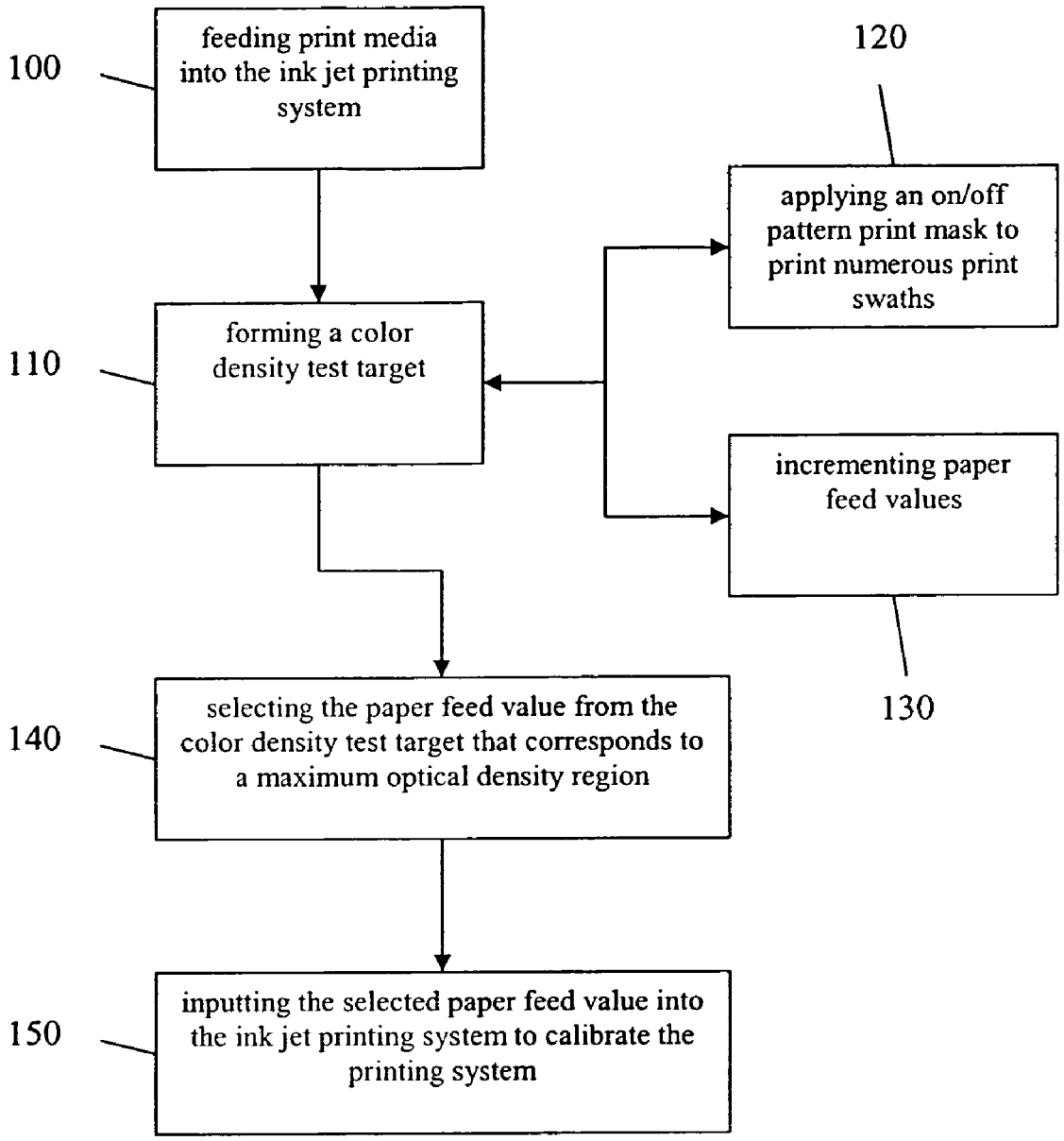
FIG. 1 is a schematic of an embodiment of a method to calibration of paper feed in an ink jet printing system.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

Media feed related banding is a gross image quality anomaly. Media feed calibration is typically done through printing a target while continuously changing media feed advance distance. At an ideal paper feed value, the target looks uniform no horizontal banding. This ideal paper feed value is selected and input into the printer as the calibrated paper feed value. Banding is thereby eliminated or substantially reduced.

The present embodiments relate to a feed calibration method in an ink jet printer. The methods entail printing a target over a range of paper feed values. The user can identify the densest area on the printed sheet that corresponds to a given paper feed value. The paper feed value is then entered into the printer, thereby setting the paper feed.

The present embodiments relate to a major improvement over the known art taught in U.S. Pat. No. 6,137,592, which is hereby incorporated by reference.

The present embodiments provide the advantageous manner for calibration by providing color density test targets that are shorter than other targets. The shorter color density test targets saves on paper, thereby saving money and helping the environment. The embodied methods print color density test targets that typically range in length from 6 inches to 13 inches. This size is at least 50% shorter than known calibration systems, such as those taught in U.S. Pat. No. 6,137,592.

The embodied methods provide a calibration that can be done with the human eye. Additional measurement devices, such as line measure using a ruler, are not needed.

The embodied methods provide a calibration method that can be automated. The embodied methods can be completed without human aid at all. The ink jet printing systems can print a color density test target created by the embodiments, then automatically optically scan the targets using a robot operated optical scanner. The optimized paper feed value can be selected from the scan of the targets and compared to preset color density values. The optimized paper feed value can then be input automatically input to the printing system, thereby reducing the overfeed bands and underfeed bands automatically. The automatic advantage of the embodied methods provides a significant reduction in labor costs.

The present embodiments provide a calibration method that is faster to complete than the known methods. The faster calibration saves energy by reducing the amount of time needed to do the testing of the printing system and allows for print system problem to be identified quicker in order to solve problems before they become too costly.

The embodied method allow for recalibrations to be carried out over the life of the print system, thereby reducing the need to replace the print system. The print systems utilizing these methods thereby have lengthened life spans and can print high quality documents, typically resolutions over 300 dpi, without overfeed and underfeed banding. The print systems can be recalibrated to accommodate different media types and different media weights, which greatly improve the versatility of the ink jet printing system.

The present embodiments provide an advantage of reducing the under-advancing of the media image on a regular basis. Using the embodied methods, the under-advancing of the media image can be routinely monitored, thereby allowing for better control of image size and more accurate reproduction of images.

Figure 2A:
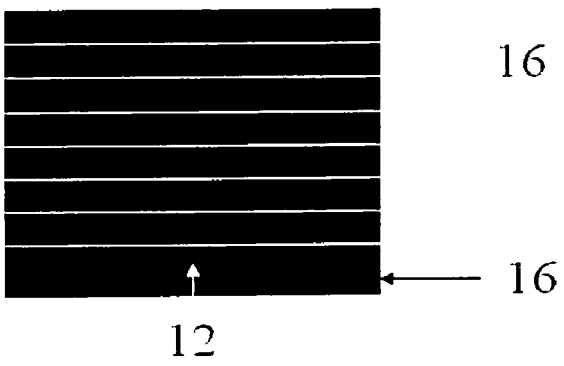
FIG. 2*a* depicts an example of an overfeed band.
Figure 2B:
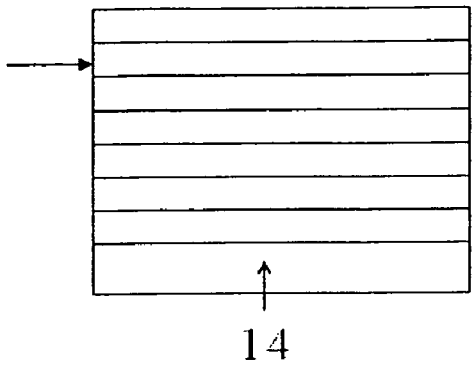
FIG. 2*b* depicts an example of an underfeed band.

With reference to the figures, FIG. 1 is a schematic of an embodiment of a method for calibration of paper feed in an ink jet printing system. The methods are used to remove overfeed bands and underfeed bands from an image. Overfeed bands are light bands that appear in printing. Underfeed bands are dark bands that appear in the printing. FIG. 2*a* depicts an example of an overfeed band 12 on an image 16. FIG. 2*b* depicts an example of an underfeed band 14 on an image 16.

The method begins by feeding print media into the ink jet printing system (Step 100) and forming a color density test target 22 (Step 110).

The color density test target 22 is formed by simultaneously, which involves applying an on/off pattern print mask 26 (Step 120) and incrementing paper feed values 30*a*, 30*b*, and 30*c* (Step 130). FIG. 3 examples an on/off pattern print mask 26 with a checkerboard embodiment. The on/off pattern print mask 26 is applied using a plurality of print swaths 28*a*, 28*b*, and 28*c* to print the test target while the paper feed values 30*a*, 30*b*, and 30*c* are incremented.

The method continues by selecting the paper feed value from the color density test target 22 that corresponds to a maximum optical density region 24 on the color density test target 22 (Step 140).

Figure 4:
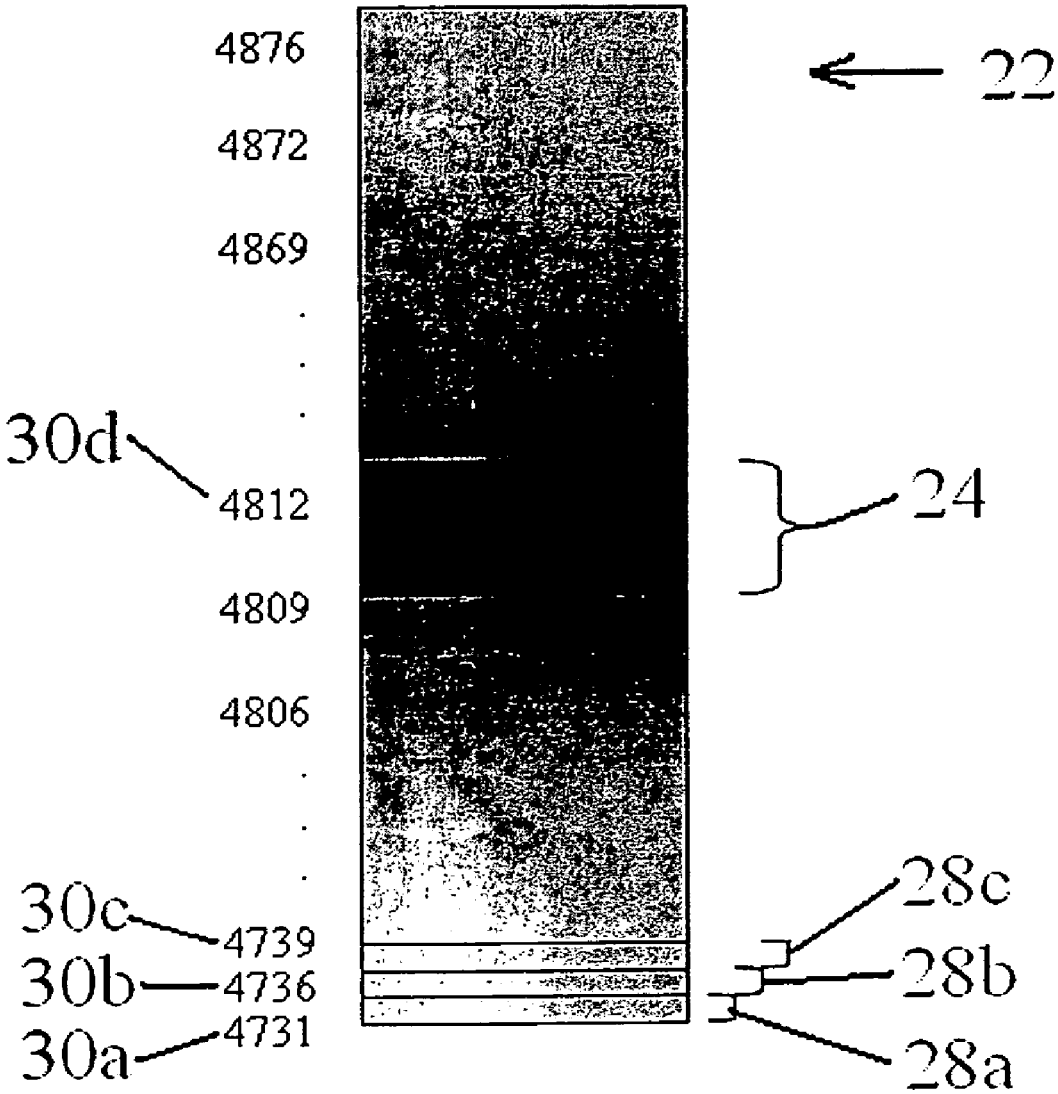
FIG. 4 examples a color density test target formed from the embodied methods.

The method ends by inputting the paper feed value that corresponds to the maximum optical density region 24—"4809" shown in FIG. 4—into the ink jet printing system (Step 150). Inputting the paper feed value calibrates the printing system in order to minimize the presence of overfeed bands and underfeed bands while printing.

Returning to FIG. 3, the on/off pattern print mask 26 can be made of other patterns, such as square patterns and rectangular patterns. The checkerboard print mask includes dark color areas and light color areas that correspond to the on/off pattern 26 for each print swath 28*a*, 28*b*, and 28*c* that are shown in FIG. 4. If the calibration is incorrect, repeated printing passes reveal a overfeed or underfeed banding which can lead to inconsistent color density. The on/off pattern print mask 26 is sensitive to vertical changes in the printer.

FIG. 4 shows the color density test target 22 with the print swaths.

Each incremented paper feed value 30*a*, 30*b*, and 30*c* corresponds respectively to a print swath 28*a*, 28*b*, and 28*c*. At least one paper feed value can correspond to up to six print swaths. The paper feed values 30*a*, 30*b*, 30*c* and 30*d* can be incremented by sequentially incrementing individual paper feed values or sequentially incrementing groups of paper feed values.

The color density test target 22 is created by performing these steps or "passes" numerous times. Typically between three and sixteen passes are required to create the color density test target 22. The preferred number of passes to create the color density test target 22 is six.

The color density test target 22 is adapted to shift from light to dark to light in order to identify a maximum optical density region 24. The maximum optical density region 24 is a maximum color concentration region on the color density test target 22. The color density test target 22 can include color information, such as black, cyan, magenta, yellow, and combinations thereof. In FIG. 4, the paper feed value that corresponds to the maximum optical density region 24 is "4812" which is designed as element 30*d*.

The embodied method can be used on ink jet printing systems with rollers for vertical feed.

Figure 5:
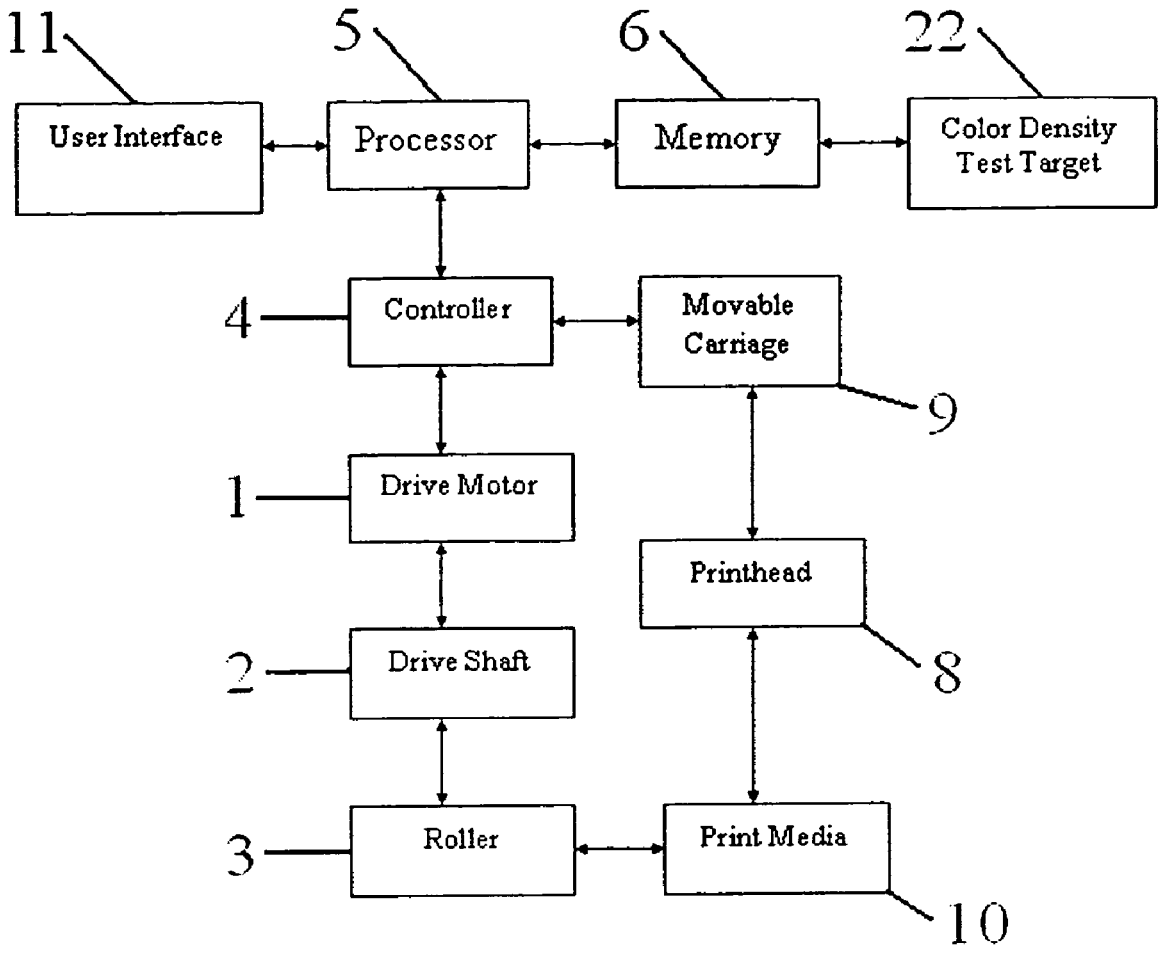
FIG. 5 depicts a schematic of a system for printing a color density test target on print media to calibrate paper feed in an ink jet printing system.

FIG. 5 depicts a schematic of a system for printing a color density test target on print media to calibrate paper feed in an ink jet printing system. The system includes a drive motor 1, a drive shaft 2 driven by the drive motor; and one or more rollers 3 coupled to the drive shaft 2. The rollers 3, therefore, move with the drive shaft 2.

The system includes controller 4 coupled to the drive motor. 1. The controller is connected to a processor 5 that includes memory 6 for storing a color density test target 22.

A printhead 8 is located on a moveable carriage 9 to print the color density test target 22 onto print media 10. A user interface 11 connects to the processor 5 to allow a user to provide input paper feed values to the processor 5 and store paper feed values into memory 6.

The invention has been described in detail with particular reference to certain preferred embodiments thereof, but it will be understood that variations and modifications can be effected within the spirit and scope of the invention.

PARTS LIST

1. drive motor
2. drive shaft
3. roller
4. controller
5. processor
6. memory
8. printhead
9. carriage
10. print media
11. user interface
12. overfeed band
14. underfeed band
16. image
22. color density test target
24. maximum optical density region
26. on/off pattern print mask
28*a*. print swath
28*b*. print swath
28*c*. print swath
30*a*. paper feed value
30*b*. paper feed value
30*c*. paper feed value
30*d*. paper feed value
100. step of feeding print media into the ink jet printing system
110. step of forming a color density test target
120. step of applying an on/off pattern print mask

130. step of incrementing paper feed values

140. step of selecting the paper feed value from the color density test target that corresponds to a maximum optical density region on the color density test target

150. step of inputting the paper feed value that corresponds to the maximum optical density region into the ink jet printing system

The invention claimed is:

1. A method for calibration of paper feed in an ink jet printing system to remove overfeed bands and underfeed bands from an image, wherein the ink jet printing system comprises rollers for vertical feed, wherein the method comprises the steps of:

a. feeding print media into the ink jet printing system;

b. forming a color density test target adapted to shift from light to dark to light in order to identify a maximum optical density region, wherein the color density test target is formed by simultaneously i. applying an on/off pattern print mask to print a plurality of print swaths, wherein the on/off pattern print mask is susceptible to vertical feed changes in the ink jet printing system; and ii. incrementing paper feed values, wherein each paper feed value corresponds respectively to each print swath;

c. selecting the paper feed value from the color density test target that corresponds to a maximum optical density region on the color density test target; and d. inputting the paper feed value that corresponds to the maximum optical density region into the ink jet printing system to calibrate the printing system in order to minimize the presence of overfeed bands and underfeed bands while printing.

2. The method of claim 1, further comprising the step of reviewing the color density test target for the absence of a banding artifact.

3. The method of claim 1, further comprising the step of evaluating the color density test target based on preset color density values using an automated process.

4. The method of claim 3, wherein the automated process comprises an optical sensor to review the color density test target and compare the sensed data to preset color density values.

5. The method of claim 1, wherein the on/off pattern print mask is a checkerboard print mask.

6. The method of claim 5, wherein the checkerboard print mask comprises a plurality of dark color areas and plurality of light color areas that correspond to the on/off pattern for each print swath.

7. The method of claim 1, wherein the maximum optical density region is a maximum color concentration region on the color density test target.

8. The method of claim 1, wherein the step of forming a color density test target color density test target is performed using from three to sixteen passes.

9. The method of claim 8, wherein the step of forming a color density test target color density test target is performed using six passes.

10. The method of claim 1, wherein the color density target comprises a color selected from the group consisting of black, cyan, magenta, yellow, and combinations thereof.

11. The method of claim 1, wherein at least one paper feed value corresponds to up to six print swaths.

12. The method of claim 1, wherein the step of incrementing paper feed values is performed by incrementing individual paper feed value in sequence.

13. The method of claim 1, wherein the step of incrementing paper feed values is performed by incrementing through groups of paper feed values in sequence.

14. The method of claim 1, wherein the ink jet printing system provides unidirectional printing.

15. A system for printing a color density test target on print media to calibrate paper feed in an ink jet printing system to remove overfeed bands and underfeed bands from an image, wherein the system comprises:

a. a drive motor;

b. a drive shaft driven by the drive motor;

c. a roller coupled to the drive shaft;

d. a controller coupled to the drive motor;

e. a processor comprising memory adapted to store a color density test target;

f. a printhead disposed on a moveable carriage adapted to print the color density test target on print media; and g. a user interface adapted to allow paper feed values to be input wherein feeding print media into the ink jet printing system; and wherein the system is adapted to i. form a color density test target adapted to shift from light to dark to light in order to identify a maximum optical density region, by using an on/off pattern print mask to print a plurality of print swaths, wherein the on/off pattern print mask is susceptible to vertical feed changes in the ink jet printing system; while incrementing paper feed values; and ii. identify the paper feed value from the color density test target that corresponds to a maximum optical density region on the color density test target; in order to calibrate the printing system to minimize the presence of overfeed bands and underfeed bands while printing.

* * * * *